United States Patent [19]

Parker et al.

[11] Patent Number: 4,736,740

[45] Date of Patent: Apr. 12, 1988

[54] GAS MASK WITH VOICE COMMUNICATION DEVICE

[76] Inventors: Robin Parker; Paul E. Richards, both of P.O. Box 517, Franklin, Ohio 45005

[21] Appl. No.: 774,223

[22] Filed: Sep. 9, 1985

[51] Int. Cl.[4] ..... A62B 18/08

[52] U.S. Cl. ..... 128/201.19

[58] Field of Search ..... 128/201.19; 179/121 R, 179/121 D, 121 T, 138, 146; 340/384 R, 384 E, 388, 393; 181/158

[56] References Cited

U.S. PATENT DOCUMENTS

| | | | |
|---|---|---|---|
| 2,123,196 | 1/1938 | Millard . | |
| 2,950,360 | 8/1960 | Duncan | 128/201.19 |
| 3,064,089 | 11/1962 | Ward | 128/201.19 |
| 3,174,129 | 3/1965 | Laughlen et al. | 128/201.19 |
| 3,180,333 | 4/1965 | Lewis . | |
| 3,210,723 | 10/1965 | Martelli et al. | 128/201.19 |
| 3,218,687 | 11/1965 | Brock et al. | 128/201.19 |
| 3,540,442 | 11/1970 | Holloway | 128/201.19 |
| 3,622,791 | 11/1971 | Bernard | 179/138 |

FOREIGN PATENT DOCUMENTS

| | | | |
|---|---|---|---|
| 737725 | 10/1932 | France | 128/201.19 |
| 492664 | 9/1938 | United Kingdom | 128/201.19 |
| 2081550 | 2/1982 | United Kingdom | 128/201.19 |

*Primary Examiner*—Edward M. Coven
*Assistant Examiner*—K. M. Reichle
*Attorney, Agent, or Firm*—Jacox & Meckstroth

[57] ABSTRACT

A face mask carries a voice communication device including a circular housing having voice transmitting openings and an annular seat which receives a flexible film diaphragm. The diaphragm is clamped to the seat by an inner circular member which has voice transmitting openings surrounding a socket for receiving a plug-in microphone. The housing receives an outer circular shield member which also has voice transmitting openings and defines a socket for receiving a plug on a microphone cord. Electrical conductor wires extend from the microphone socket through a passage around the diaphragm to the cord socket. A sealant material is injected into the passage and into an annular chamber which is defined between the housing and the inner microphone support member and receives a peripheral edge portion of the diaphragm.

15 Claims, 1 Drawing Sheet

GAS MASK WITH VOICE COMMUNICATION DEVICE

BACKGROUND OF THE INVENTION

In the use of face masks by firemen, military personnel and other individuals who are exposed to toxic gases or must receive a supply of oxygen, it is common to provide a communication system which may be in the form of a microphone, amplifier and speaker system, for example, as disclosed in U.S. Pat. No. 3,180,333. The speaker may also be remote from the mask and connected by flexible wire conductors to a microphone located within the mask, for example, as disclosed in U.S. Pat. No. 2,123,196. It is also common in some masks to provide a direct non-electrical voice transmitting device which incorporates a diaphragm supported within the mask by a fitting or housing having voice transmitting openings. The voice of the person wearing the mask is transmitted directly through the openings and through the diaphragm which prevents any toxic gas from flowing into the mask through the voice transmitting openings.

SUMMARY OF THE INVENTION

The present invention is directed to a face or gas mask incorporating an improved voice communication system or device which provides for both direct voice communication as well as electrical voice communication from a microphone. The device of the invention is compact and simple to install within a face mask and also provides for a sealed structure which prevents toxic gases from flowing through the device. The communication device of the invention also provides for using interchangable microphone modules and for positively sealing an internal diaphragm which transmits a voice without the passage of any gas.

In accordance with one embodiment of the invention, a communication device includes a housing which is adapted to mount within a circular opening in a face mask. The housing receives an inner microphone support member having a socket with conductor pins for receiving a removable microphone module. A diaphragm disk is formed of a plastics film material and is sandwiched between the housing and the microphone support member. Conductor wires extend from the microphone support socket through a passage extending around the diaphragm to a set of conductor pins which project forwardly into a socket formed within a front shield member secured to the housing. An epoxy sealant material is injected into the passage which receives the conductor wires. The sealant material is also injected into an annular chamber which is defined between the housing and the microphone support member and which receives a peripheral portion of the diaphragm.

Other features and advantages of the invention will be apparent from the following description, the accompanying drawing and the appended claims.

DESCRIPTION OF THE PREFERRED EMBODIMENT

Figures 1, 2, 3:
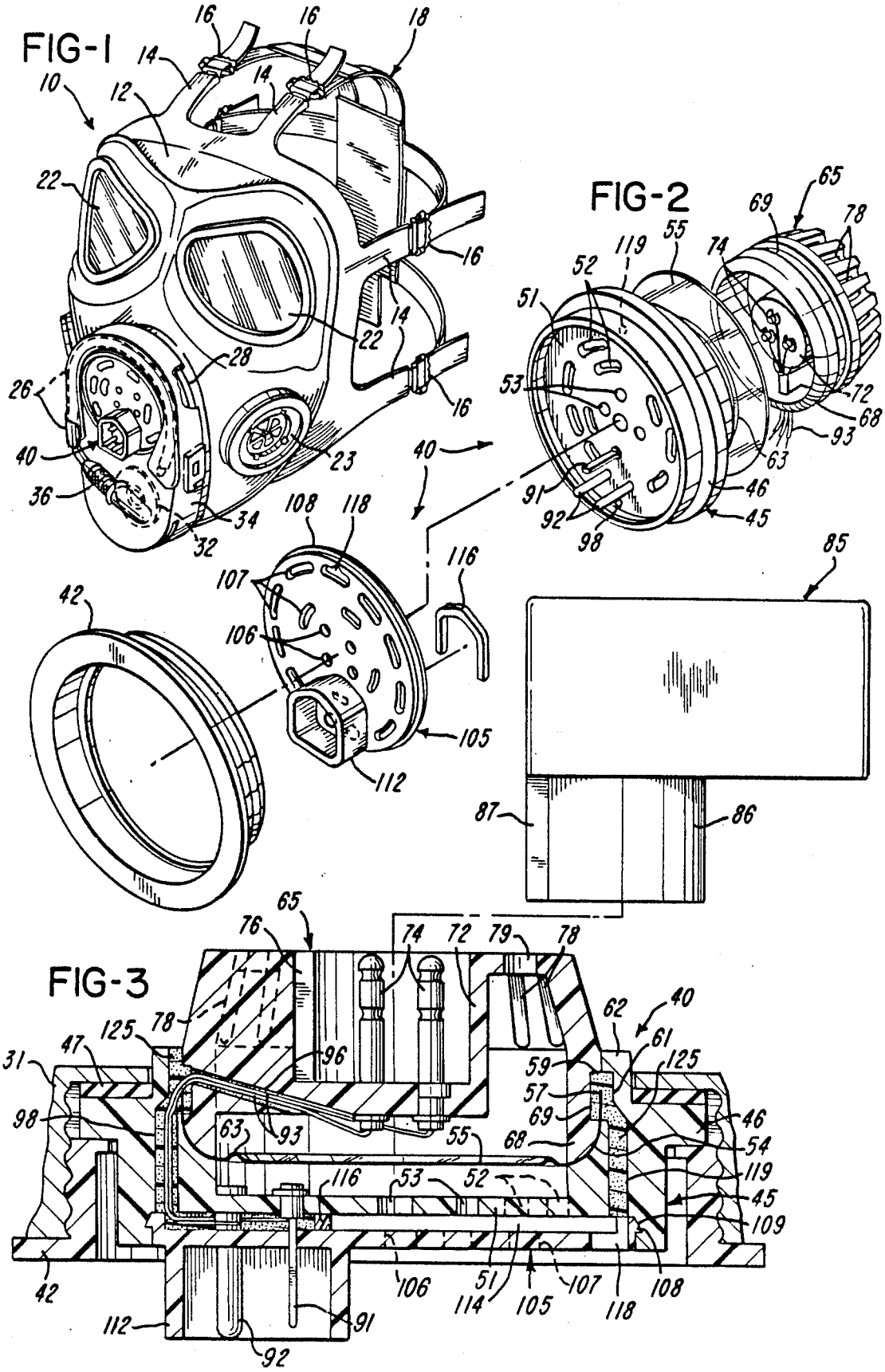
FIG. 1 is a perspective view of a face mask incorporating a communication device constructed in accordance with the invention.
FIG. 2 is an exploded perspective view of the components forming the communication device installed on the mask shown on FIG. 1.
FIG. 3 is an enlarged axial section of the assembled communication device shown in FIGS. 1 and 2.

FIG. 1 illustrates a face mask 10 of the type commonly used or worn by firemen and including a molded or rubber resilient body 12 having a set of integrally molded straps 14 attached to corresponding buckles 16. The buckles 16 receive corresponding straps of a headpiece 18 for securing the mask 10 to the wearer's head. A pair of lenses or windows 22 are provided in the mask body 12 for viewing by the wearer of the mask, and a fitting 23 is provided within the body 12 to receive a supply of filtered air.

The face mask 10 also includes an inner cup (not shown) of flexible rubber material for covering the mouth and nose of the wearer. A flexible tube 26 extends from the cup through a mask projection 28 which also supports an internally threaded fitting 31 and an exhalation check valve 32. A molded rubber cover 34 snap-fits onto the projection 28 and retains the tube 26 along with a fitting 36 for connecting the tube to a water supply (not shown).

In accordance with the present invention, a voice communication device 40 is inserted into the internally threaded fitting 31 and is retained or secured by a ring 42 which has external threads for engaging the fitting. The communication device 40 includes a circular housing 45 molded of a rigid plastics material and having an outwardly projecting circumferential flange 46 which engages a resilient sealing gasket 47 supported within the fitting 31.

The housing 45 also has an internal circular flat wall 51 with a set of voice transmitting openings 52 and 53. An annular seat 54 is formed within the housing 45 and has a curved cross-sectional configuration. A cup-shaped flexible diaphragm 55 contacts the seat 54 and has a peripheral edge portion 57 which projects axially into an annular chamber 59 defined in part by a groove 61 within a generally cylindrical ring portion 62 of the housing 45. Preferably, the diaphragm 55 is made from a polyimide film sold under the trademark "Kapton", and the film is coated on both sides with a moisture resistant material sold under the trademark "Teflon". The diaphragm 55 has an annular rib 63 which is deformed into the film to provide for uniform movement of the diaphragm 55 within the housing 45.

The housing 45 receives an inner microphone support member 65 which is also molded of the rigid plastics material and includes a ring portion 68 having an external circumferential groove 69 which opposes the groove 61 within the housing 45 to define the annular chamber 59. The lower end surface of the ring portion 68 mates with the curved seat 54 to hold the diaphragm 55 firmly against the seat.

The microphone support member 65 also includes an inner cup-shaped hub or cylindrical socket portion 72 which supports a set of three parallel spaced electrical connector pins 74 and has a key slot 76. The socket portion 72 is surrounded by circumferentially spaced voice transmitting slots or openings 78 and 79, respectively. As shown in FIG. 3 the socket portion 72 is adapted to receive a microphone module 85 which has a cylindrical base portion 86 with a rib or key 87 so that the base portion fits within the socket portion 72 of the support member 65. The microphone element within the module 85 may be a magnetic or dynamic type which incorporates a permanent magnet or the microphone may be an electric microphone having an electromagnet.

The base wall 51 of the housing 45 supports a set of three electrical conducting pins 91 and 92 which are connected by corresponding conductor wires 93 to corresponding connector pins 74 within the socket 72. The conductor wires 93 extend through a hole 96 formed or drilled within the microphone support member 65, through the annular chamber 59 and then through a hole or passage 98 formed within the housing 45. As shown in FIG. 3, the ring portion 62 has an interruption directly above the passage 98.

The forward end of the housing 45 receives a closure or shield member 105 which is molded of a rigid plastics material and has circumferentially spaced voice transmitting openings 106 and 107. The shield member 105 has an outer peripheral edge portion 108 which hooks or snapfits into an under-cut groove 109 within the housing 45. The shield member 105 also includes a forwardly projecting socket portion 112 which surrounds the conductor pins 91 and 92 and is adapted to receive a mating plug (not shown) on the end of a flexible microphone cord.

A gap or space 114 is defined between the base wall 51 of the housing 45 and the shield member 105 and receives a U-shaped gasket 116 which is cemented to the shield member 105 and extends around the conductor pins 91 and 92. The shield member 105 also has a hole 118 which aligns with a hole or passage 119 extending axially within the housing 45 to the annular chamber 59.

The communication device 40 is assembled by first connecting or soldering the wires 93 to the microphone connector pins 74 and then threading the wires through the holes or passages 96 and 98. The diaphragm 55 is then placed on the seat 54, and the microphone support member 65 is pressed into the housing 45 so that the peripheral edge portion 57 of the diaphgragm projects into the annular chamber 59. The conductor wires 93 are then attached to the pins 91 and 92, and the shield member 105 is moved down on the pins and snap-fitted into the housing 45.

An epoxy sealant material 125 is placed within a syringe having a needle which is inserted through the hole 118 and into the passage 119 within the housing 45. The sealant material is then injected into the annular chamber 59 to fill the chamber after which the material flows into the passage 96 within the microphone support member 65. The sealant material also fills the passage 98, the interruption above the passage 98 and a portion of the space 114 enclosed by the gasket 116 between the base wall 51 of the housing 45 and the shield member 105. When the sealant material hardens, the microphone support member 65 is locked to the housing 45, and the peripheral edge portion 57 of the diaphragm 55 is positively sealed to the housing 45 and support member 65. The conductor wires 93 are also embedded in the sealant material to prevent any movement by the wires.

As apparent from the drawing and the above description, a voice communication unit or device constructed in accordance with the invention provides desirable features and advantages. For example, as a primary advantage, the device 40 provides a combined voice emitter and electrical voice transmitting unit in which a microphone module may be easily and quickly installed. The construction and assembly of the unit or device 40 with the epoxy sealant also assures a positively sealed and locked-together structure which has substantial durability and provides for conveniently connecting a microphone cord or cable as well as the microphone module. The location of the openings 52 and 53 and the openings 106 and 107 in laterally off-set relation also protect the diaphragm 55 from being punctured by a thin article which might accidentally engage the device 40.

While the form of communication device herein described constitutes a preferred embodiment of the invention, it is to be understood that the invention is not limited to this precise form of device, and that changes may be made therein without departing from the scope and spirit of the invention as defined in the appended claims.

The invention having thus been described, the following is claimed:

1. In a gas mask assembly including a resilient mask body adapted to cover an individual's face, and lens means within said body to provide for viewing through said body, an improved voice communication device comprising a generally cup-shaped housing having a base wall with voice transmitting openings and forming a cavity and an internal annular seat within said cavity, means for securing said housing in said mask body and for forming a fluid-tight seal therebetween, a gas impervious voice transmitting diaphragm of a flexible film material, said diaphragm having an outer peripheral portion engaging said seat, a microphone support member projecting into said cavity of said housing and including an annular portion pressing said peripheral portion of said diaphragm against said annular seat, removable microphone, first plug-in means for releasably connecting said microphone to said support member, shield means secured to said housing and having second plug-in means adapted for releasably connecting a microphone cord, said base wall of said housing being disposed between said microphone support member and said shield means, said microphone support member and said shield means each having voice transmitting openings, said openings within said support member and said openings within said base wall being disposed on opposite sides of said diaphragm, and a plurality of flexible electrical conductors connected to said first plug-in means and extending within said housing from said microphone support member generally around said diaphragm to said second plug-in means of said shield means, to provide for a combined electrical and direct voice transmitting unit.

2. A gas mask assembly as defined in claim 1 wherein said housing and said microphone support member define an annular chamber therebetween, said chamber receives said outer peripheral portion of said diaphragm, said housing defines a passage extending from said chamber to said first plug-in means and receiving said electrical conductors, and a fluid sealant material disposed within said chamber and said passage.

3. A gas mask assembly as defined in claim 2 wherein said second plug-in means comprise a set of parallel spaced electrical pins supported by said housing and projecting through said shield means, said second plug-in means further including socket means on said shield means for surrounding said pins, and said conductors are connected to said pins.

4. A gas mask assembly as defined in claim 1 wherein said annular seat in said housing is curved in cross-section, said diaphragm has a cup-shaped configuration, and said microphone support member includes a cooperatively shaped annular surface mating with and opposing said seat for confining said peripheral portion of said diaphragm therebetween.

5. A gas mask assembly as defined in claim 1 wherein said housing and said microphone support member define an annular chamber therebetween, and a sealant material is disposed within said chamber to form positive connection of said microphone support member to said housing.

6. A gas mask assembly as defined in claim 5 wherein said peripheral portion of said diaphragm also projects into said annular chamber, and said peripheral portion is embedded within said sealant material in said chamber.

7. A gas mask assembly as defined in claim 1 wherein said second plug-in means includes wall means projecting from said shield means which defines a socket, and said second plug-in means further including a set of parallel spaced electrical conductor pins connected to said conductors and secured to said housing and projecting into said socket.

8. A gas mask assembly as defined in claim 7 wherein said housing includes an annular portion which projects from said base wall and defines an inner annular groove, said shield means has a peripheral portion which snap-fits into said annular groove within said housing, and a sealant material is disposed between said base wall of said housing and said shield means and around said conductor pins.

9. A gas mask assembly as defined in claim 1 wherein said microphone support member defines a socket generally surrounded by said voice transmitting openings within said support member, said first plug-in means including a set of parallel spaced conductor pins connected to said conductors and projecting from said support member into said socket, and said first plug-in means further including means on said microphone for projecting into said socket and receiving said pins.

10. A voice communication device adapted for use on a gas mask, comprising a cup-shaped housing having a base wall with voice transmitting openings and forming a cavity and an internal annular seat within said cavity, a gas impervious voice transmitting diaphragm of a flexible film material, said diaphragm having an outer peripheral portion engaging by said seat, a microphone support member projecting into said cavity of said housing and including an annular portion pressing said peripheral portion of said diaphragm against said seat, a removable microphone, first plug-in means for releasably connecting said microphone to said support member, shield means secured to said housing and having second plug-in means adapted for releasably connecting a microphone cord, said base wall of said housing being disposed between said microphone support member and said shield means said microphone support member and said shield means each having voice transmitting openings, said openings within said support member and said openings within said base wall being disposed on opposite sides of said diaphragm and a plurality of flexible electrical conductors connected to said first plug-in means and extending within said housing from said microphone support member generally around said diaphragm to said second plug-in means of said outer shield means, to provide for a combined electrical and direct voice transmitting unit.

11. A voice communication device as defined in claim 1 wherein said housing and said microphone support member define an annular chamber therebetween, said chamber receives said outer peripheral portion of said diaphragm, said housing defines a passage extending from said chamber to said first plug-in means for receiving said electrical conductors, and a fluid sealant material disposed within said chamber and said passage.

12. A voice communication device as defined in claim 1 wherein said second plug-in means comprise a set of parallel spaced electrical pins supported by said housing and projecting through said shield means, said second plug-in means further including socket means on said shield means for surrounding said pins, and said conductors are connected to said pins.

13. A voice communication device as defined in claim 10 wherein said housing and said microphone support member define an annular chamber therebetween, and a sealant material is disposed within said chamber to form positive connection of said microphone support member to said housing.

14. A voice communication device as defined in claim 13 wherein said peripheral portion of said diaphragm also projects into said annular chamber, and said peripheral portion is embedded within said sealant material in said chamber.

15. A voice communication device as defined in claim 10 wherein said microphone support member defines a socket generally surrounded by said voice transmitting openings within said support member, said first plug-in means including a set of parallel spaced conductor pins connected to said conductors and projecting from said support member into said socket, and means on said microphone for projecting into said socket and receiving said pins.

* * * * *

UNITED STATES PATENT AND TRADEMARK OFFICE

CERTIFICATE OF CORRECTION

PATENT NO. : 4,736,740

DATED : April 12, 1988

INVENTOR(S) : Robin Parker and Paul E. Richards

It is certified that error appears in the above-identified patent and that said Letters Patent are hereby corrected as shown below:

Column 4, line 33, after "seat," insert --a--.

Column 5, line 45, cancel "by".

Column 6, line 16, cancel "1" and insert --10--.

Column 6, line 24, cancel "1" and insert --10--.

Signed and Sealed this

Thirtieth Day of August, 1988

*Attest:*

DONALD J. QUIGG

*Attesting Officer*

*Commissioner of Patents and Trademarks*